US009628891B2

(12) United States Patent
Desautels et al.

(10) Patent No.: US 9,628,891 B2
(45) Date of Patent: Apr. 18, 2017

(54) ADHESIVELESSLY CUSTOMIZABLE CONTAINMENT OF A DELICATE ELECTRICAL APPARATUS SUCH AS EARBUDS

(71) Applicants: John Fredrick Desautels, Mill Creek, WA (US); Katherine Ann Burks, Mill Creek, WA (US)

(72) Inventors: John Fredrick Desautels, Mill Creek, WA (US); Katherine Ann Burks, Mill Creek, WA (US)

( * ) Notice: Subject to any disclaimer, the term of this patent is extended or adjusted under 35 U.S.C. 154(b) by 0 days.

(21) Appl. No.: 14/756,077

(22) Filed: Jul. 29, 2015

(65) Prior Publication Data

US 2016/0044400 A1 Feb. 11, 2016

Related U.S. Application Data

(60) Provisional application No. 61/999,746, filed on Aug. 5, 2014.

(51) Int. Cl.

| | |
|---|---|
| ***H04R 25/00*** | (2006.01) |
| ***H04R 1/10*** | (2006.01) |
| ***B65H 75/28*** | (2006.01) |
| ***B65H 75/18*** | (2006.01) |
| ***B65H 75/14*** | (2006.01) |

(52) U.S. Cl.

CPC ..... *H04R 1/1033* (2013.01); *B65H 75/141* (2013.01); *B65H 75/182* (2013.01); *B65H 75/28* (2013.01); *B65H 2701/3919* (2013.01)

(58) Field of Classification Search

CPC ..... B65H 75/28; B65H 75/182; B65H 2701/3919; B65H 2701/50; H04R 1/1033; H04R 1/02; A45F 5/021

USPC ..... 381/385, 301, 333, 384, 422, 172, 388, 381/189, 160, 69, 48, 44, 306, 9, 8

See application file for complete search history.

(56) References Cited

U.S. PATENT DOCUMENTS

| | | | | |
|---|---|---|---|---|
| D595,120 | S * | 6/2009 | Plowman | D8/356 |
| 8,083,064 | B2 | 12/2011 | Boswell et al. | |
| 8,114,492 | B2 | 2/2012 | Palmer et al. | |
| 8,260,661 | B2 | 9/2012 | Bortolin et al. | |
| 8,519,824 | B1 | 8/2013 | Rankin et al. | |
| 8,541,496 | B2 | 9/2013 | Sereboff | |
| 8,608,371 | B2 | 12/2013 | Bartholomew et al. | |
| 8,626,668 | B2 | 1/2014 | Butler et al. | |
| 8,752,705 | B2 | 6/2014 | Adler et al. | |
| 8,776,683 | B2 | 7/2014 | Schneider | |
| 8,787,610 | B2 | 7/2014 | Stevinson | |
| 8,812,355 | B2 | 8/2014 | Angell et al. | |
| 8,828,301 | B2 | 9/2014 | Furey et al. | |
| 8,842,872 | B2 | 9/2014 | Stevinson | |

(Continued)

OTHER PUBLICATIONS

"My Account"; CableTurtle.com; 2015; 2 pages; Fort Lauderdale, FL, USA; http://cableturtle.com/how-it-works.

(Continued)

*Primary Examiner* — MD S Elahee
*Assistant Examiner* — Julie X Dang
(74) *Attorney, Agent, or Firm* — Bold IP, PLLC; Hyungsoo Ahn

(57) ABSTRACT

Structures and protocols are presented for supporting a delicate apparatus including an electrical conduit, such as earbuds, in a manner that is readily customized to a particular end user or supplier with or without adhesive.

20 Claims, 9 Drawing Sheets

(56) References Cited

U.S. PATENT DOCUMENTS

| | | | | |
|---|---|---|---|---|
| 8,899,071 | B2 | 12/2014 | Mogil et al. | |
| 8,919,587 | B2 | 12/2014 | Howell et al. | |
| 8,955,240 | B1 | 2/2015 | Loftus et al. | |
| 8,963,926 | B2 | 2/2015 | Brown et al. | |
| D723,533 | S | 3/2015 | Stevinson | |
| D724,573 | S | 3/2015 | Stevinson | |
| 8,985,432 | B2 | 3/2015 | Cullen et al. | |
| 8,991,688 | B1 | 3/2015 | Daboub et al. | |
| 9,003,665 | B2 | 4/2015 | Pelton | |
| 9,022,248 | B2 | 5/2015 | Vandenlangenberg | |
| 9,031,858 | B2 | 5/2015 | Angell et al. | |
| 9,061,873 | B2 | 6/2015 | Humele | |
| 9,064,395 | B2 | 6/2015 | Shearin et al. | |
| 9,085,667 | B2 | 7/2015 | Aksay et al. | |
| 9,089,059 | B1 | 7/2015 | Haskin et al. | |
| 2007/0076907 | A1* | 4/2007 | Stagni | H04R 1/1041 381/124 |
| 2011/0036676 | A1* | 2/2011 | Skillman | B65H 75/143 191/12.4 |
| 2013/0271902 | A1* | 10/2013 | Lai | H04R 1/02 361/679.01 |

OTHER PUBLICATIONS

"Fun Facts About the Cable Turtle"; CableTurtle.com; 2015; 2 pages; Fort Lauderdale, FL, USA; http://cableturtle.com/blog/fun-facts-about-the-cable-turtle.

"Expensive New Pair of Earbuds? Beats, Bose and Sennheiser All Need Earbud Protection"; Digital Innovations; Feb. 6, 2015; 5 pages; http://www.digitalinnovations.com/expensive-new-earbuds-beats-bose-sennheiser-need-earbud-protection-2015-02-06/.

* cited by examiner

ADHESIVELESSLY CUSTOMIZABLE CONTAINMENT OF A DELICATE ELECTRICAL APPARATUS SUCH AS EARBUDS

CROSS-REFERENCE TO RELATED APPLICATIONS

The present application claims benefit of priority of U.S. App. No. 61/999,746 (filed 5 Aug. 2014) or is an application of which a currently co-pending application is entitled to the benefit of the filing date.

TECHNICAL FIELD

This disclosure relates to cost-effective, protective containment of devices.

SUMMARY

An embodiment provides a method. In one implementation, the method includes but is not limited to configuring or otherwise obtaining a base having first and second barriers and a reel element configured so that a first edge of the reel element attaches to the first barrier and so that a second edge of the reel element attaches to the second barrier and so that a first cavity of the base partly bounded by the first and second barriers and by the reel element is large enough to contain the first interface of a delicate apparatus and to various modes of customizing or using the base. In addition to the foregoing, other method aspects are described in the claims, drawings, and text forming a part of the present disclosure.

In one or more various aspects, related machines, compositions of matter, or manufactures of systems may include virtually any combination permissible under 35 U.S.C. §101 configured to effect the herein-referenced method aspects depending upon the design choices of the system designer.

An embodiment provides a system relating to a tag and to an electrical apparatus that includes a first interface and a second interface. In one implementation, the system includes but is not limited to a base that includes a reel element having an inside partly bounding a first cavity large enough to contain the first interface of the electrical apparatus and also having an outside configured to engage a conduit of the electrical apparatus that connects the first and second interfaces of the electrical apparatus and that also includes a first barrier adjoining a first edge of the reel element and partly bounding the first cavity large enough to contain the first interface of the electrical apparatus and that also includes a second barrier adjoining a second edge of the reel element and partly bounding a second cavity configured to grip the tag releasably and partly bounding the first cavity large enough to contain the first interface of the electrical apparatus, the reel element at least partly defining an annulus of the base large enough to receive the conduit of the electrical apparatus. In addition to the foregoing, other system aspects are described in the claims, drawings, and text forming a part of the present disclosure.

In addition to the foregoing, various other method and/or system and/or program product aspects are set forth and described in the teachings such as text (e.g., claims and/or detailed description) and/or drawings of the present disclosure. The foregoing is a summary and thus may contain simplifications, generalizations, inclusions, and/or omissions of detail; consequently, those skilled in the art will appreciate that the summary is illustrative only and is NOT intended to be in any way limiting. Other aspects, features, and advantages of the devices and/or processes and/or other subject matter described herein will become apparent in the teachings set forth below.

BRIEF DESCRIPTION OF THE FIGURES

For a more complete understanding of embodiments, reference now is made to the following descriptions taken in connection with the accompanying drawings. The use of the same symbols in different drawings typically indicates similar or identical items, unless context dictates otherwise. The illustrative embodiments described in the detailed description, drawings, and claims are not meant to be limiting. Other embodiments may be utilized, and other changes may be made, without departing from the spirit or scope of the subject matter presented here.

DETAILED DESCRIPTION

For a more complete understanding of embodiments, reference now is made to the following descriptions taken in connection with the accompanying drawings. The use of the same symbols in different drawings typically indicates similar or identical items, unless context dictates otherwise. The illustrative embodiments described in the detailed description, drawings, and claims are not meant to be limiting. Other embodiments may be utilized, and other changes may be made, without departing from the spirit or scope of the subject matter presented here.

Figure 1:
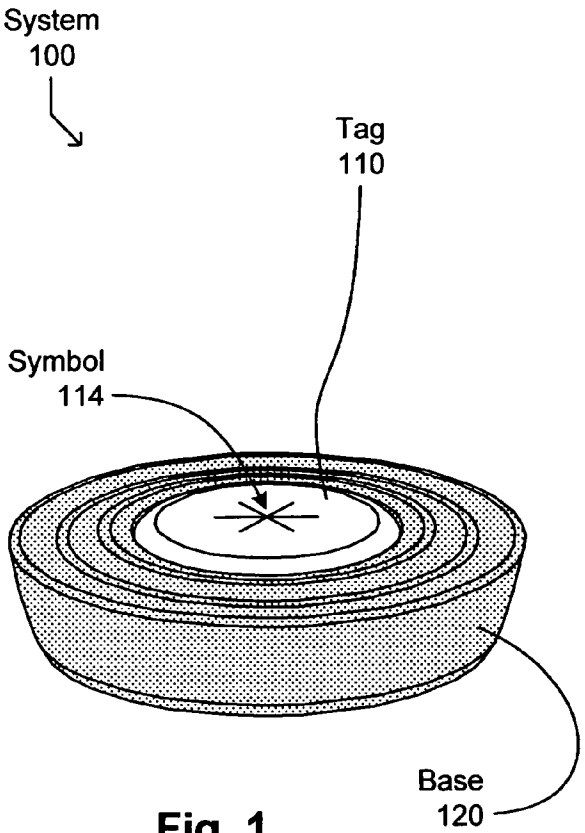
FIG. 1 depicts a base that grips a tag and that may also contain an electrical device.

With reference now to FIG. 1, shown is a system 100 comprising a base 120 that grippingly supports a tag 110 bearing a symbol 114. System 100 may (optionally) also include a delicate electrical device comprising first and second interfaces operably coupled by a conduit supported within base 120.

Figure 2:
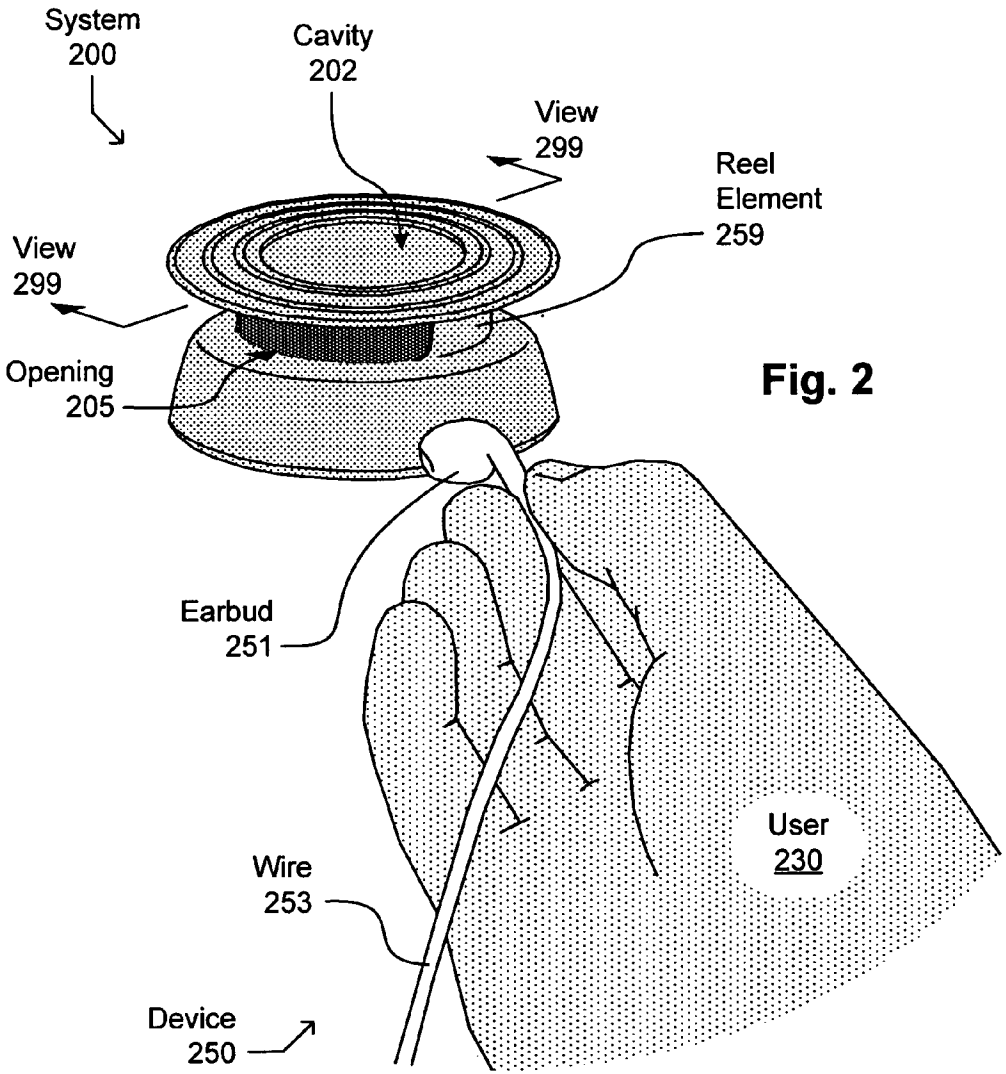
FIG. 2 depicts a system by which a user may engage a delicate electrical apparatus

With reference now to FIG. 2, shown is a system 200 (optionally implementing system 100, e.g.) by which a user 230 may engage both a customization tag (see FIGS. 4, 5, and 7) and an electrical apparatus (device 250, e.g.) that includes a first interface (earbud 251, e.g.) and a second interface. System 200 includes one or more reel elements 259 each having an inside partly bounding a first cavity (a nominally cylindrical cavity large enough to contain an earbud 251 inserted through opening 205, e.g.) and an outside as well as first and second layers each adjoining a respective edge of the reel element(s) 259 and also bounding the first cavity. The outside of each of the one or more reel element(s) 259 is configured to engage a conduit (wire 253, e.g.) of the electrical apparatus. In respective variants either or both of the layers may also include another cavity 202 configured to receive and grip a tag 110 or a customization tag as described below. Tags 110 having an unwanted symbol 114 may thus be removed and replaced easily, providing a cost effective mode of customizing system 200. Although removable tag 110 and cavity 202 are nominally circular as shown, it is envisioned that either or both of these may be rectangular or otherwise polygonal or any of several other shapes and that such gripping may be effectively reversible and reconfigurable by having tags and cavities with suitably matched dimensions, as exemplified herein. A cross-sectional view 299 of a base consistent with that of FIG. 2 is shown, for example, at FIG. 8.

Those skilled in the art will recognize that some list items may also function as other list items. Each such listed term should not be narrowed by any implication from other terms in the same list but should instead be understood in its broadest reasonable interpretation as understood by those skilled in the art.

"Acrylic," "bounded," "colorimetric," "customized," "distinctive," "elastomeric," "electrical," "elongate," "enough," "first," "greater," "incremental," "inside," "large," "less," "outside," "particular," "partly," "plastic," "second," "smaller," "synthetic," "thinner," "transparent," "visible," or other such descriptors herein are used in their normal yes-or-no sense, not as terms of degree, unless context dictates otherwise. "To" is not used to articulate a mere intended purpose in phrases like "configured to," moreover, but is used normally, in descriptively identifying a particular device or pattern that is actually performing or implementing a task or arrangement or to a structure that can serve this function without significant modification. Positional relation terms like "along" or "adjacent" are used herein to refer to nominal (substantially ideal, e.g.) relations, having a difference or deviation of at most about 10° or 10% or 10 millimeters, unless context dictates otherwise.

In light of teachings herein, numerous existing techniques may be applied for configuring mechanical elements having useful properties (markings or elastomeric or plastic components, e.g.) as described herein without undue experimentation. See, e.g., U.S. Pat. No. 9,022,248 ("Portable beverage container with a permanent neoprene cover"); U.S. Pat. No. 9,085,667 ("Reinforced polymeric articles"); U.S. Pat. No. 9,064,395 ("Bezel with non-metallic materials for cover or platter for a data reader in a checkout station"); U.S. Pat. No. 9,061,873 ("Device and method for producing plastic containers"); U.S. Pat. No. 9,003,665 ("Identification tag with breakaway tool"); U.S. Pat. No. 8,985,432 ("Reusable foldable shipping container"); U.S. Pat. No. 8,955,240 ("Greeting card with pull activated effects"); U.S. Pat. No. 8,919,587 ("Plastic container with angular vacuum panel and method of same"); U.S. Pat. No. 8,828,301 ("In-mold labeling systems with polymeric label receptor and in-mold labeling methods therewith"); U.S. Pat. No. 8,752,705 ("Packaging system with pharmacy bottle and label"); U.S. Pat. No. 8,541,496 ("Energy absorbing composition and impact and sound absorbing applications thereof"); U.S. Pat. No. 8,114,492 ("Labeled containers made from expandable thermoplastic materials having improved physical properties"); and U.S. Pat. No. 8,083,064 ("Sustainable packaging for consumer products").

Figure 3:
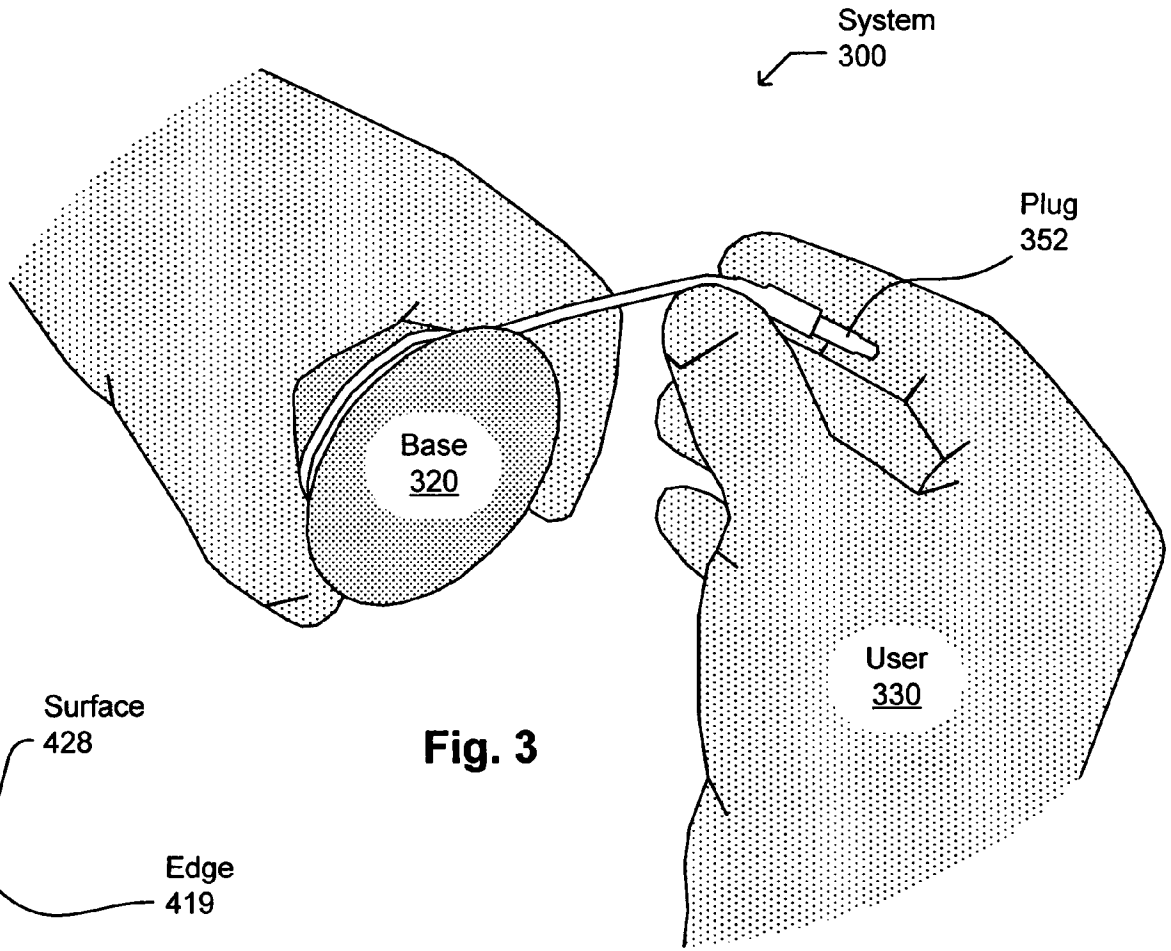
FIG. 3 depicts an oblique view of a base in which a proximal interface of a delicate apparatus has been installed, in which a conduit of the apparatus has been wound around the primary cavity, and in which a user is holding a distal interface.

With reference now to FIG. 3, shown is a system 300 that includes an oblique view of a base 320 (a variant of base 120, e.g.) in which a proximal interface (earbud 251, e.g.) of a delicate apparatus (device 250, e.g.) has been installed (into an opening 205 of a primary cavity, e.g.), in which a conduit (wire 253, e.g.) of the apparatus has been wound around the primary cavity, and in which user 330 is holding a distal interface (plug 352, e.g.).

Figure 4:
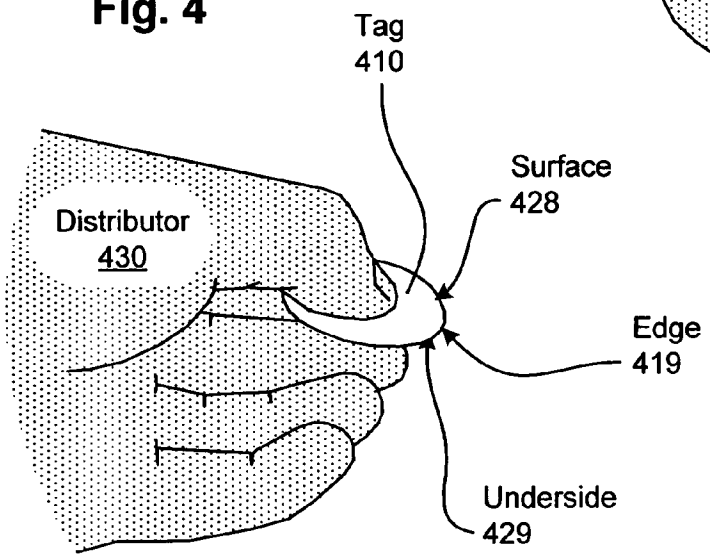
FIG. 4 depicts an oblique view of a tag by which a distributor can customize a system/base as described herein.

With reference now to FIG. 4, shown is an oblique view of a customization tag 410 by which a distributor 430 can customize a system 100, 200 as described above. A removable tag 110 may be taken out of base 120, for example, exposing a cavity 202 of a non-customized base (like that of system 200, e.g.). This permits customization tag 410, held as shown, to be installed therein with an underside 429 toward the base 120 and with a lip of the base 120 laterally gripping one or more edges 419 of the customization tag 410. See FIG. 11. In some variants, moreover, a customization tag 410 may include a transparent material (acrylic, e.g.) having one or more curved surfaces 428 and configured to magnify a visible expression (a word or image, e.g.) within the tag 410 or on its underside 429. See FIG. 7.

Figure 5:
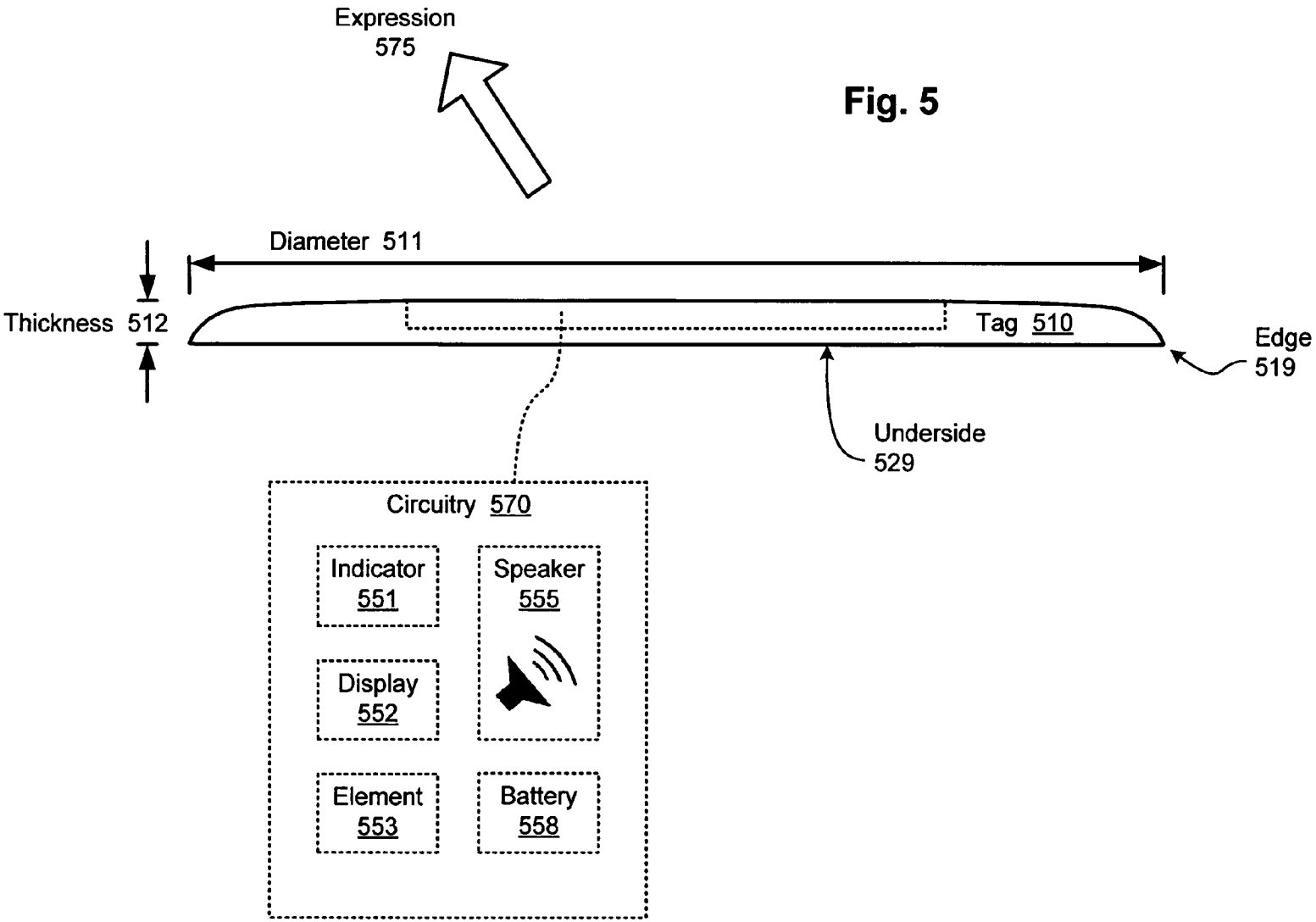
FIG. 5 depicts a profile view of a tag having an elongate profile and configured to transmit a visible or other expression.
Figure 7:
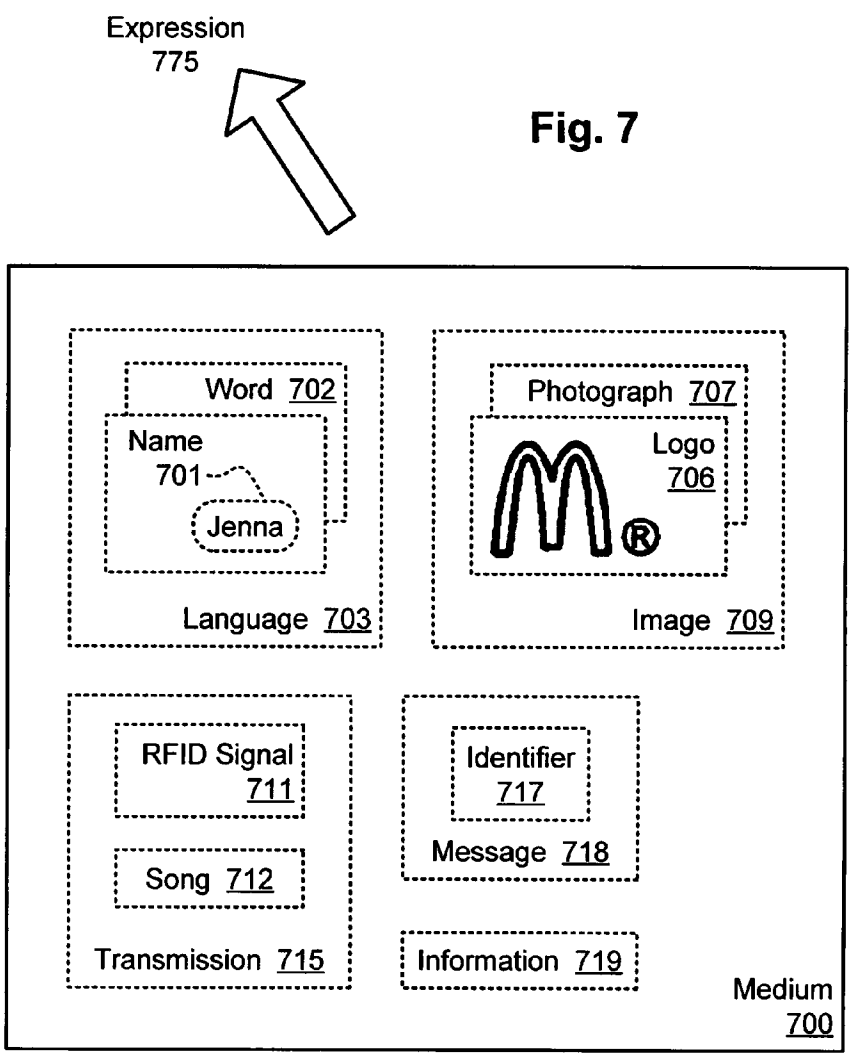
FIG. 7 depicts a non-volatile medium upon which some human- or device-readable language or other customization content may be stored.

With reference now to FIG. 5, shown is a profile view of a customization tag 510 having a diameter 511 of 1-5 centimeters, an elongate profile, and a thickness 512 on the order of 1 millimeter (i.e. within an order of magnitude) configured to emit or otherwise transmit 575 a visible, audible, or other expression 575 wirelessly. This can occur, for example, in a context in which the profile of tag 510 is "elongate" by virtue of having a (nominal) length or diameter 511 more than twice its thickness 512; in which tag 510 is configured as an optically transmissive material (a plano-convex or meniscus lens, e.g.) with a painted or otherwise applied image or other visible information (as depicted in FIG. 7, e.g.) formed on an underside 529 thereof; and in which tag 510 has one or more rounded, beveled, or other tapered edges 519 by which it can be gripped (partly within a side of base 320, e.g.). Alternatively or additionally, tag 510 may (optionally) include active circuitry 570 including one or more instances of configurable indicators 551 (light emitting diodes, e.g.), of active displays 552, of digital transmission elements 553 (comprising an antenna, e.g.), of speakers 555, or of batteries 558.

Figure 6:
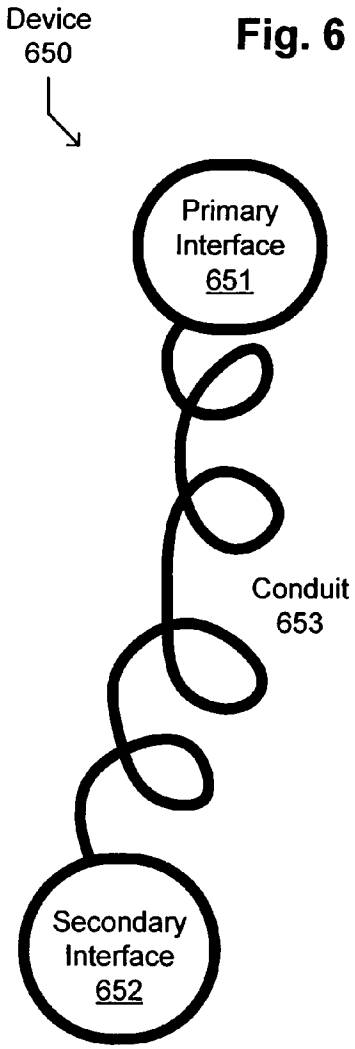
FIG. 6 depicts an electronic device comprising interfaces operably coupled by a flexible conduit susceptible of becoming tangled, dirty, or damaged.

With reference now to FIG. 6, shown is an electronic device 650 comprising a primary interface 651 and a secondary interface 652 operably coupled by a flexible conduit 653 susceptible of becoming tangled, dirty, or damaged (in a drawer or pocket, e.g.).

With reference now to FIG. 7, shown is a non-volatile medium 700 upon which some human- or device-readable language 703 (including a person's name 701, a word 702, or phrase, e.g.) or one or more instances of images 709 (a logo 706 or photograph 707, e.g.) or of sequenced transmissions 715 (a song 712 or video clip, e.g.) or of other messages 718 (identifiers 717, e.g.) or other information 719 relating to cost-effective system customization may be stored. In some variants of customization tags 410, 510, such expressions 575, 775 may also be presented visibly (as static images 709 painted on the tag or as dynamic images 709 presented on an active display 552 powered by battery 558, e.g.). Alternatively or additionally, some such content may be presented audibly (via a speaker 555 powered by battery 555, e.g.) or emitted as a wireless transmission 715 not humanly perceivable (a radio frequency identification signal 711, e.g.).

Figure 8:
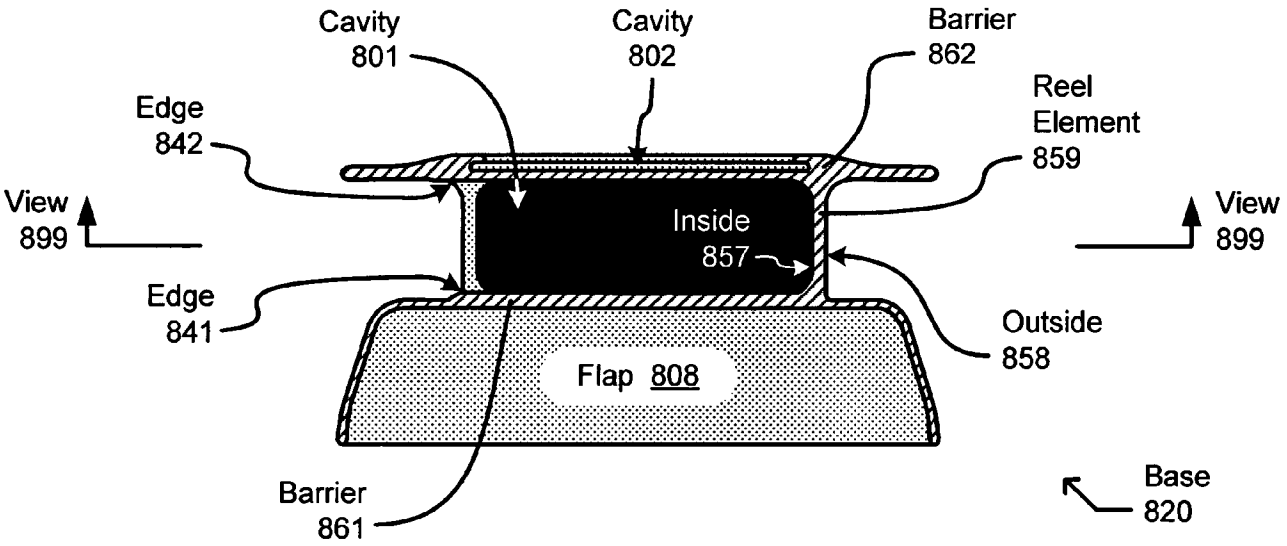
FIG. 8 depicts a cross-sectional view of a base consistent with that of FIG. 2.

With reference now to FIG. 8, shown is a cross-sectional view 299 of base 820, a variant component of the system 200 depicted in FIG. 2. As shown one or more arcuate, segmented, or other reel elements 859 each has an inside 857 partly bounding a first cavity 801 large enough to contain a first interface (primary interface 651, e.g.) of a delicate apparatus (device 650, e.g.) and an outside 858 configured so that a user 330 can spool a wire 253 or other conduit 653 of the apparatus (operably coupling the first interface with one or more plugs 352 or other secondary interfaces 652, e.g.) around the reel element(s) 859. As shown first barrier 861 adjoins a first edge 841 of the reel element(s) and partly bounds the first cavity 801 and second barrier 862 adjoins a second edge 842 of the reel element(s) and also partly bounds the first cavity 801 (so that the second barrier divides the first and second cavities, e.g.). Alternatively or additionally, either or both barriers 861, 862 may partly bound a second cavity 802 configured to grip a customization tag 410, 510 or other tag 110. Alternatively or additionally, either or both barriers 861, 862 may include a bistable flap 808 bendable by user 330 as described below. For further detail about the reel element(s) 859, a cross-sectional view 899 of a variant of base 820 is presented below in relation to FIG. 10.

Figure 9:
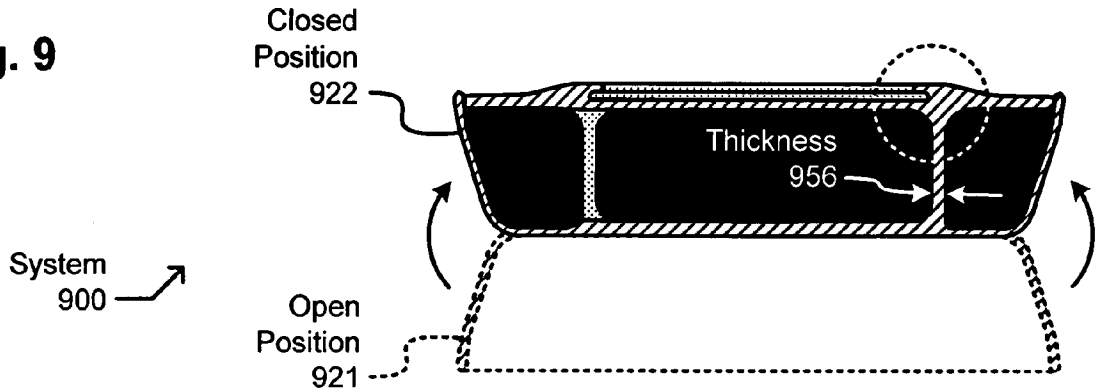
FIG. 9 depicts a system configured to engage a removable tag or an electrical apparatus and also signals how a bistable annular flap thereof may be flipped.

With reference now to FIG. 9, an embodiment is shown that comprises a system 900 configured to engage either or both of a removable tag 110, 410, 510 or an electrical apparatus (such as one or more devices 250, 650) that includes a first interface 651 (one or more earbuds 251, e.g.) and a second interface 652 (one or more plugs 352, e.g.) and a conduit 653 (one or more wires 253, e.g.) therebetween that operably couples the first and second interfaces. A standard (non-customized) base 120, 320, 820 of the system comprises one or more reel elements 259, 859 (having a nominal thickness 956 on the order of 1 millimeter, e.g.) between first and second barriers 861, 862, the reel element(s) each having an inside 857 partly bounding a first cavity 801 large enough to contain the first interface of the electrical apparatus and an outside configured to engage the conduit of the electrical apparatus. The first barrier 861 adjoins a first edge 841 of the reel element 859 and partly bounds the first cavity 801. The second barrier 862 likewise adjoins a second edge 842 of the reel element 859 and partly bounds the first cavity 801. The first cavity is large enough to contain the first interface 651 of the electrical apparatus and has one or more openings 205 large enough to admit the first interface 651. The second barrier 862 adjoins a second edge 842 of the reel element 859 and partly bounds a second cavity 802 configured to grip the removable tag. FIG. 9 also signals how a bistable annular flap 808 may be flipped by hand from an open position 921 to a closed position 922 and back.

Figure 10:
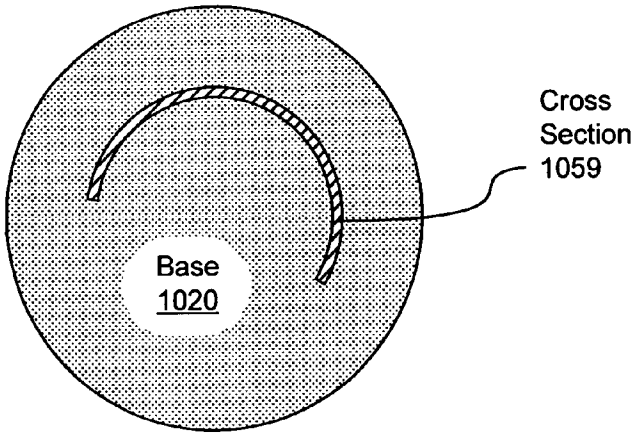
FIG. 10 depicts a base in which a reel element has a C-shaped cross section.

With reference now to FIG. 10, a base 1020 is shown that is a variant of the base 820 of FIG. 8, one in which a contiguous version of reel element 859 has a C-shaped cross section 1059.

Figure 11:
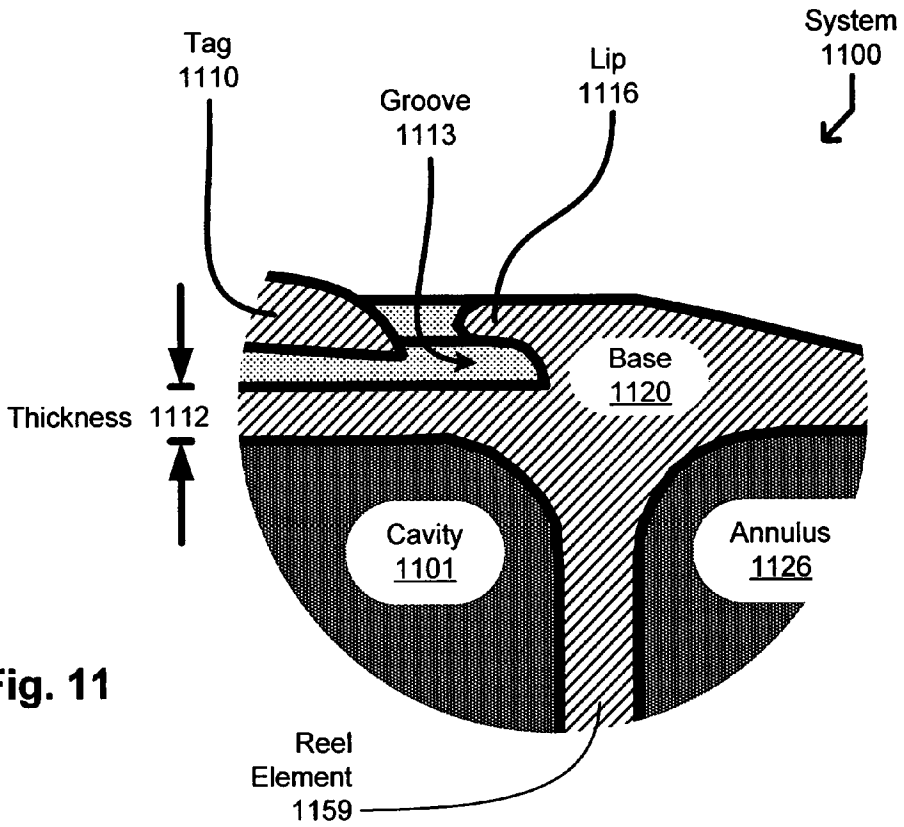
FIG. 11 depicts a system that includes a customizable base (configured to accommodate a customization tag, e.g.).

With reference now to FIG. 11, shown is a system 1100 that includes a non-customized base 1120 configured to accommodate a customization tag 1110. Base 1120 includes one or more segmented, arcuate, or other reel elements 1159 nominally dividing a cavity 1101 (configured to receive an earbud 251 or other first interface 651 of a delicate device, e.g.) from an annulus 1126 (configured to receive a braided wire or other conduit 653 of a delicate device 650, e.g.) surrounding cavity 1101. As shown, base 1120 includes a second barrier similar to barrier 862 (as depicted in FIG. 8), the nominal median thickness 1112 of which is on the order (within an order of magnitude) of 1 millimeter. The second barrier also includes a thicker portion that supports a lip 1116 that extends radially inward to form a groove 1113 large enough to accommodate customization tag 1110. In respective variants such grooves 1113 may be positioned along both sides of an elongate slot or in several places (in an annular ring, e.g.) around a (nominally) round or polygonal tag (see below). In some variants tag 1110 may have a (nominal) median thickness 512 that is greater than a (nominal) median thickness 1112 of the second barrier 862. Alternatively or additionally, one of the reel element(s) may have a median thickness 956 greater than a median thickness 1112 of the second barrier.

In light of teachings herein, numerous existing techniques may be applied for handling delicate components as described herein without undue experimentation. See, e.g., U.S. Pat. No. 9,089,059 ("Device packaging system"); U.S. Pat. No. 8,899,071 ("Container with cover and closure member"); U.S. Pat. No. 8,842,872 ("Keyed earphone caddy and carrying case"); U.S. Pat. No. 8,787,610 ("Ergonomic system for compact winding and storage of earphone set/headphones used with digital media devices"); U.S. Pat. No. D724,573 ("Combo side opening earphone case"); U.S. Pat. No. D723,533 ("Separable earphone case"); and U.S. Pub. No. 20130148839 ("Keyed earphone caddy and carrying case")

Figure 12:
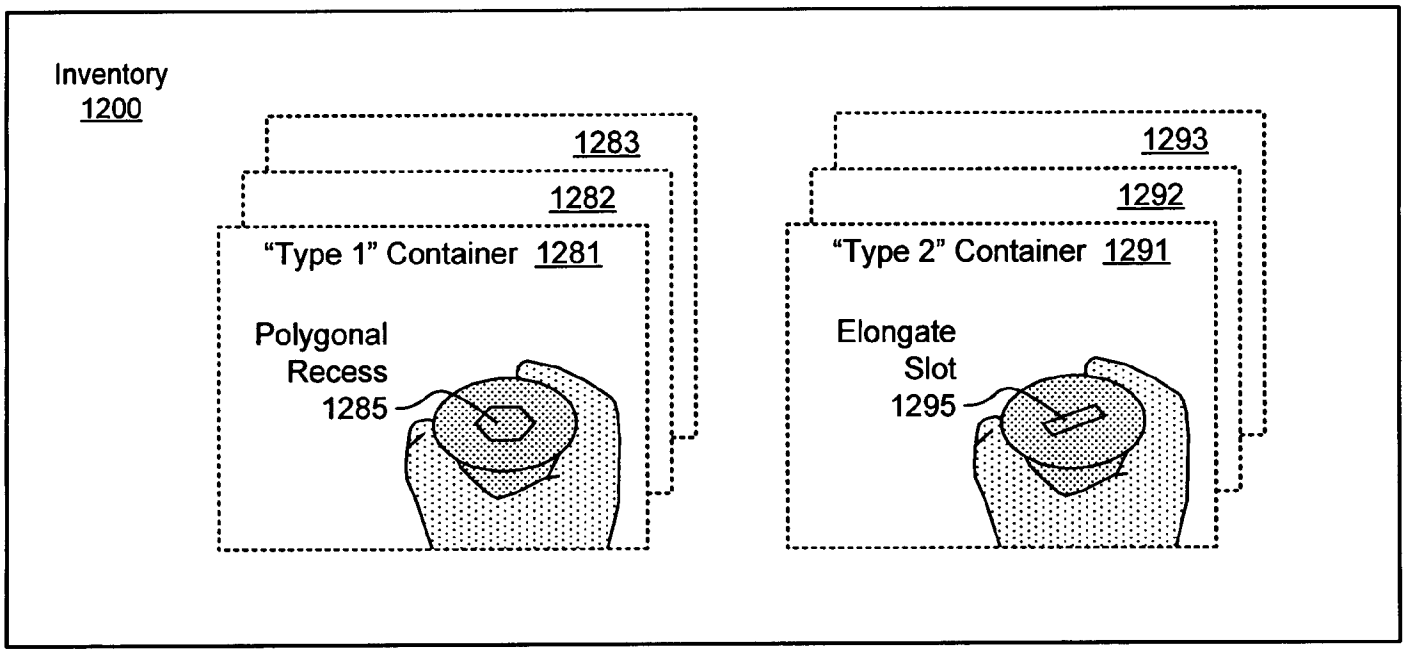
FIG. 12 depicts one or more inventories of containers/bases as described herein.

With reference now to FIG. 12, shown are one or more inventories 1200. One such inventory may include many instances of "Type 1" containers 1281, 1282, 1283, for example, such containers all being nominally identical—not customized—and each having at least one polygonal recess 1285 configured to receive a customization tag 410, 510, 1110. Alternatively or additionally the one or more inventories 1200 may include many instances of "Type 2" containers 1291, 1292, 1293 all being nominally identical and each having at least one elongate slot 1295 for receiving a customization tag 410, 510, 1110. Alternatively or additionally the one or more inventories 1200 may include many instances of other containers all being nominally identical and each having at least one other kind of "second cavity" (a circular, radially uniform instance of groove 1113, e.g.) matched to a customization tag 410, 510, 1110 having a footprint incrementally smaller than the second cavity (having an area at least 99% thereof and nominally of the same footprint shape, e.g.).

In light of teachings herein, numerous existing techniques may be applied for effective inventory management as described herein without undue experimentation. See, e.g., U.S. Pat. No. 9,031,858 ("Using biometric data for a customer to improve upsale ad cross-sale of items"); U.S. Pat. No. 8,991,688 ("System and method for providing goods, services or information using scannable code"); U.S. Pat.

No. 8,963,926 ("User customized animated video and method for making the same"); U.S. Pat. No. 8,812,355 ("Generating customized marketing messages for a customer using dynamic customer behavior data"); U.S. Pat. No. 8,776,683 ("Process for manufacturing absorbent products having customized graphics"); U.S. Pat. No. 8,752,705 ("Packaging system with pharmacy bottle and label"); U.S. Pat. No. 8,626,668 ("Individualized digital media delivery systems"); U.S. Pat. No. 8,608,371 ("Automated customized cosmetic dispenser"); U.S. Pat. No. 8,519,824 ("Customizable service space"); and U.S. Pat. No. 8,260,661 ("System and apparatus for linking multiple rewards programs to promote the purchase of specific product mixes").

An embodiment comprises a system 1100 configured to engage either or both of a releasable tag 110, 410, 510, 1110 or an electrical apparatus (such as one or more devices 250, 350, 650) that includes a first interface 651 (one or more earbuds 251, e.g.) and a second interface 652 (one or more plugs 352, e.g.) and a conduit 653 (one or more wires 253, e.g.) therebetween that operably couples the first and second interfaces of the electrical apparatus. A standard (non-customized) base 120, 320, 820, 1020, 1120 of the system comprises a reel element 259, 859, 1159 between first and second barriers 861, 862, the reel element having an inside 857 partly bounding a first cavity 801, 1101 large enough to contain the first interface of the electrical apparatus and an outside configured to engage the conduit of the electrical apparatus. The first barrier 861 adjoins a first edge 841 of the reel element 859 and partly bounds the first cavity 801. The second barrier 862 likewise adjoins a second edge 842 of the reel element 859 and partly bounds the first cavity 801. The first cavity is large enough to contain the first interface 651 of the electrical apparatus and has an opening 205 large enough to admit the first interface 651 (between the first cavity and an annulus 1126 of the base, e.g.). The second barrier 862 adjoins a second edge 842 of the reel element 859 and partly bounds a second cavity 802 configured to grip the customization tag (with each edge 419, 519 thereof inserted into a groove 1113 of and gripped by a lip 1116 of the second barrier 862 of the base, e.g.).

Figure 13:
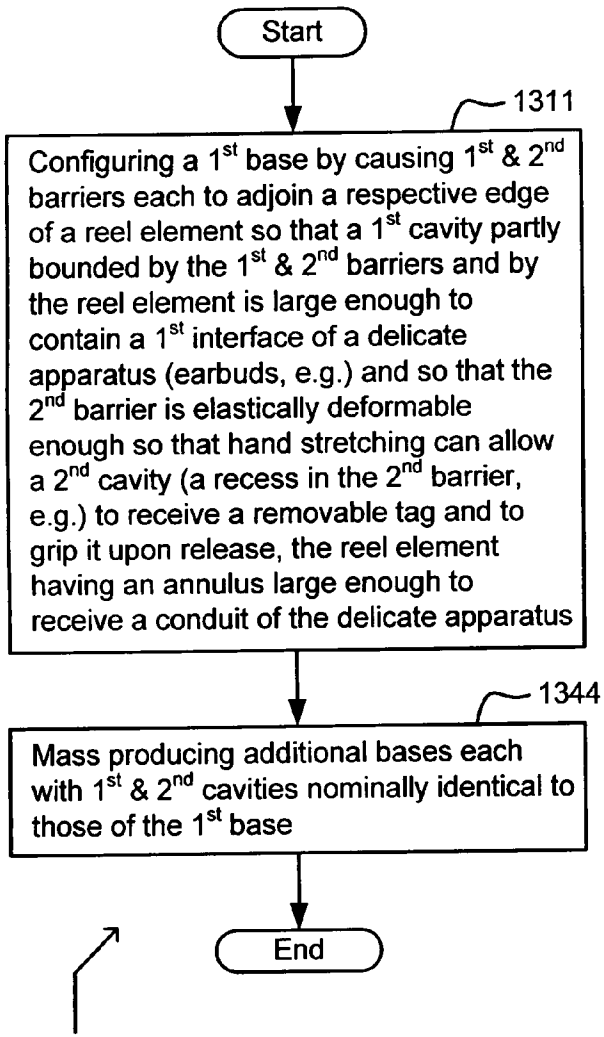
FIG. 13 depicts a flow of an operational process by which some bases/systems described herein may be produced.

With reference now to FIG. 13, shown is a flow 13 of an operational process by which one or more bases 120, 320, 820, 1020, 1120 or systems described herein may be produced. Operation 1311 describes configuring a first base by causing first and second barriers each to adjoin a respective edge of a reel element so that a first cavity partly bounded by the first and second barriers and by the reel element is large enough to contain a first interface of a delicate apparatus and so that the second barrier is elastically deformable enough so that hand stretching can allow a second cavity to receive a removable tag and to grip it upon release, the reel element having an annulus large enough to receive a conduit of the delicate apparatus (e.g. a manufacturer fabricating a non-customized base 320 by injection molding a form that includes barriers 861, 862 adjoining respective edges 841, 842 of one or more reel elements 859 so that a first cavity 801 partly bounded by the barriers 861, 862 and reel element(s) is large enough to contain a primary interface 651 of device 650 and so that the "second" barrier 862 is elastically deformable enough so that manual stretching can easily allow a second cavity 802 therein to receive one or more tags 410, 1110 and to grip the tag(s) upon release from the stretching). This can occur, for example, in a context in which the one or more reel elements 859 partially delimit an annulus 1126 large enough to receive a conduit 653 and secondary interface 652 of the delicate apparatus; in which such elasticity is achieved by constructing at least a portion of the second barrier 862 (primarily composed of synthetic rubber, e.g.) having a tensile modulus on the order of 10 or of 100 megapascals and a median thickness 1112 on the order of 1 millimeter; and in which the second barrier 862 would otherwise require a permanent adhesive to maintain contact with tag 1110. Alternatively or additionally, one or more such tags may be removably affixed to a non-customized base by magnets, screws, or other such nonadhesive couplings.

Operation 1344 describes mass producing additional non-customized bases each with first and second cavities nominally identical to those of the first base (e.g. the manufacturer making thousands of copies of base 320 by repeating operation 1311). This can occur, for example, in a context in which such bases are made cost-effectively by specifying normal manufacturing tolerances (as contrasted with high precision, e.g.), normal production times (as contrasted with an expedited schedule, e.g.), and slower shipping methods (by container shipment and not air freight, e.g.) prior to customization and in which many thousands of completed containers 1281, 1282, 1283 (bases 320, e.g.) of a single type are maintained in an inventory 1200 (also prior to customization, e.g.). Alternatively or additionally, such bases 320 may be machine-preassembled (with a tag 110 having a default symbol 114, e.g.) so that a decision can be deferred until order time whether to ship them from inventory 1200 without delay (in a non-customized form) or to customize them to order (by quickly removing the default tags 110 and replacing them with tags 110 that provide a customizing expression 775 within a few days after a retail or end user order, e.g.).

Figure 14:
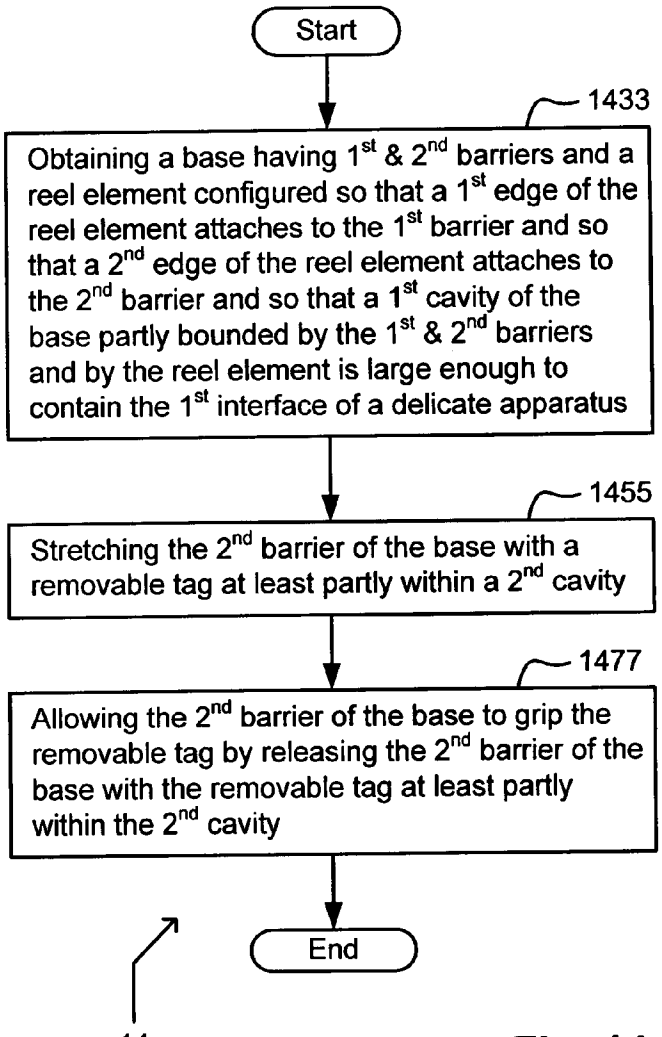
FIG. 14 depicts a flow of an operational process by which some bases/systems described herein may be adapted.

With reference now to FIG. 14, shown is a flow 14 of an operational process. Operation 1433 describes obtaining a base having first and second barriers and a reel element configured so that a first edge of the reel element attaches to the first barrier and so that a second edge of the reel element attaches to the second barrier and so that a first cavity of the base partly bounded by the first and second barriers and by the reel element is large enough to contain the first interface of a delicate apparatus (e.g. a distributor 430 receiving an inventory 1200 of non-customized bases 820 from the manufacturer, each base having a first cavity 801 partly bounded by the first and second barriers 861, 862 and large enough to contain a pair of earbuds 251, e.g.). This can occur, for example, in a context in which the manufacturing included flow 13; in which the earbuds are the "first interface"; and in which device 250 is the "delicate apparatus" and includes a Y-shaped wire 253 coupling the earbuds 251 to a plug 352. Alternatively or additionally, such bases 820 may (optionally) arrive from the manufacturer with non-customized earbuds 251 or other such delicate apparatuses 650 already contained therein (as an instance of one or more systems 100, 200, 300, 900, 1100 described above, e.g.).

Operation 1455 describes stretching the second barrier of the base with a removable tag at least partly within a second cavity (e.g. distributor 430 configuring each base 820 in the obtained inventory 1200 by inserting an instance of tag 410 longitudinally into an external recess, slot, or other cavity 802 in the second barrier 862 thereof while each second barrier 862 is laterally stretched enough for circumferential or other opposing edges 419 of the tag 410 to fit under a corresponding lip 1116 adjacent the second barrier 862). This can occur, for example, in a context in which tag 1110 instantiates tag 410; in which base 1120 instantiates a base 820 of system 900; in which distributor 430 buys or makes the tags 410 to order long after having acquired the inventory 1200 of bases; and in which distributor 430 would otherwise need to acquire and maintain multiple inventories 1200 of different types of bases 1120 and containers 1281, 1291 merely to accommodate a respective variety of shapes of tags. Alternatively or additionally, such personalized tags 410 may be made by applying paint, ink, or a printed image 709 (on a decal on a flat underside of a curved refractive tag 410, e.g.).

Operation 1477 describes allowing the second barrier of the base to grip the removable tag by releasing the second barrier of the base with the removable tag at least partly within the second cavity (e.g. distributor 430 completing the installation of tag 410 into the "second" cavity 802 of the second barrier 862 by releasing the second barrier 862 with the tag at least partly within the second cavity 802). This can occur, for example, in a context in which distributor 430 either received the base 820 as shown in FIG. 2 (lacking a tag in cavity 202 thereof, e.g.) or removed an original removable tag 110 from the base 820 to make room for a substitute tag 410. Alternatively or additionally, the newly-installed tag 410 may be configured to have one or more edges 419 thereof that each extends far enough into an annular or other groove 1113 (on opposing sides thereof, e.g.) so that a sharp object inadvertently coming into contact with tag 410 (keys jostling in an overstuffed backpack with system 900, e.g.) will not unexpectedly pry tag 410 out of groove 1113.

Figure 15:
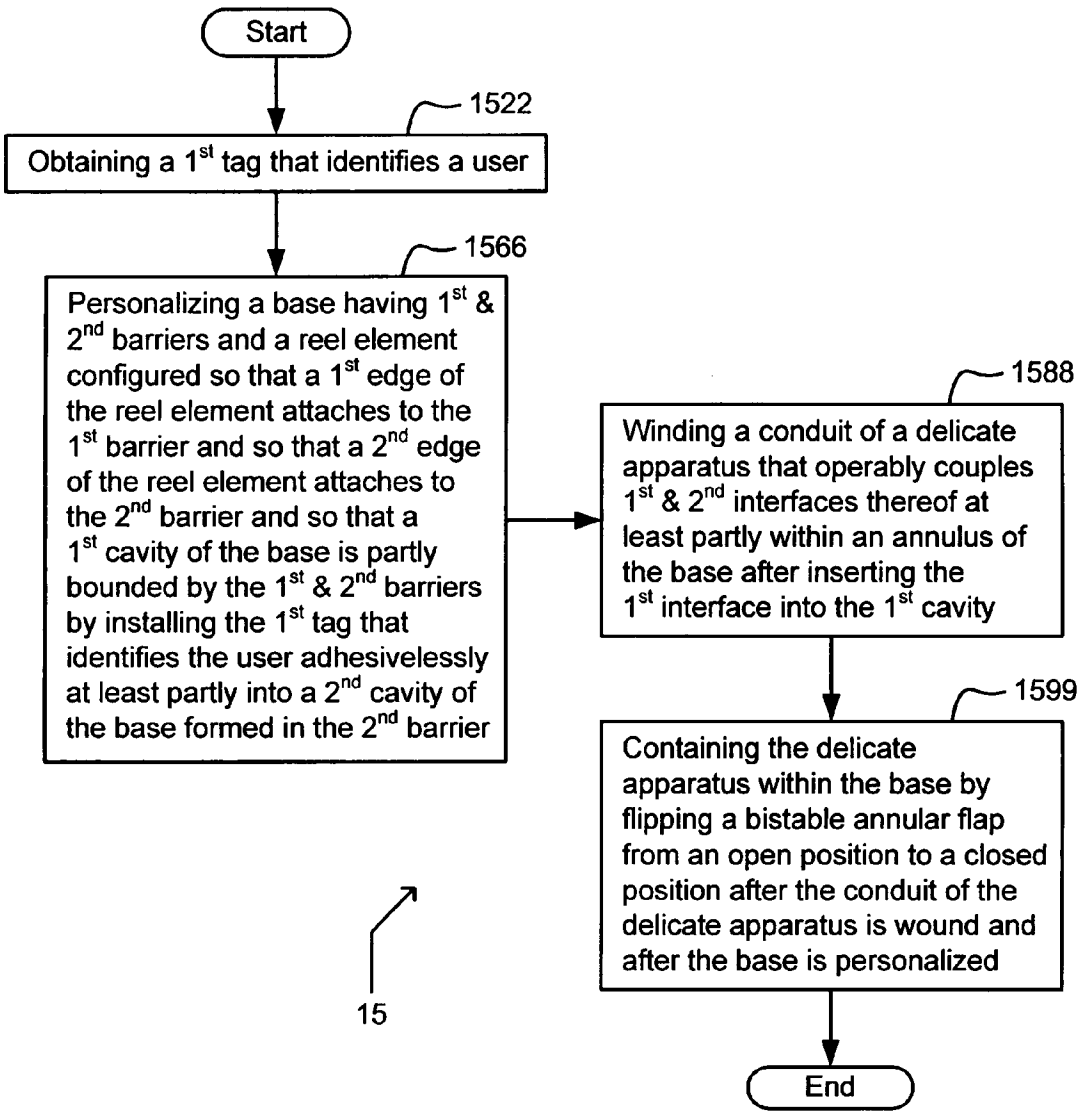
FIG. 15 depicts a flow of an operational process by which some bases/systems described herein may be personalized.

With reference now to FIG. 15, shown is a flow 15 of an operational process. Operation 1522 describes obtaining a tag that identifies a user (e.g. one or more users 230, 330 each making one or more tags 410, 510, 1110 that identify themselves). This can occur, for example, in a context in which one or more such tags are included in a kit (that includes one or more corresponding bases 320, 820, 1020, 1120, e.g.) from which a personalized or other customized containment system 300, 900, 1100 can be assembled. Alternatively or additionally, such tags 410, 510, 1110 may be hand-marked or custom-ordered for the benefit of the intended end user (for each person on a team or guest list, e.g.). In some variants, moreover, the "first" tag may include a website identifier, phone number, or other contact information 719 pertaining to a particular user.

Operation 1566 describes personalizing a base having first and second barriers and a reel element configured so that a first edge of the reel element attaches to the first barrier and so that a second edge of the reel element attaches to the second barrier and so that a first cavity of the base is partly bounded by the first and second barriers by installing the tag that identifies the user adhesivelessly at least partly into a second cavity of the base formed in the second barrier (e.g. one or more users 230, 330 or retailers personalizing a base 320, 820, 1020, 1120 as described above by positioning the user-identifying "first tag" securely, but without the need for adhesive, at least partly in a tag-accommodation cavity 202, 802 of the base). This can occur, for example, in a context in which part of the "second" barrier engages the "first" tag during the installation and in which the provider of the base (the retailer, e.g.) maintains a substantial inventory 1200 of a single type of container (only "Type 1" containers 1281, 1282, 1283, e.g.) so that the personalization only requires the respective tags 410, 510, 1110 for the several intended recipients to be configured and installed. Alternatively or additionally, a single base may be associated with a limited assortment of tags (each with a respective zodiac symbol or word 702 with which the user personally identifies, e.g.) all included with the single base in a single kit.

Operation 1588 describes winding a conduit of a delicate apparatus that operably couples first and second interfaces thereof at least partly within an annulus of the base after inserting the first interface into the first cavity (e.g. user 330 wrapping the conduit 653 of device 650 around the outside 858 of one or more reel elements 859 after inserting the primary interface 651 into cavity 801). This can occur, for example, in a context in which conduit 653 is a power cord, a ribbon coupler, or other electrical conduit; in which the second interface fits into the annulus 1126 of base 820; and in which the attachment between the first interface and the conduit would otherwise be crimped, stretched, or crushed. Alternatively or additionally, base 820 may be configured so that an opening 205 of the first cavity is large enough to receive the secondary interface 652 also.

Operation 1599 describes containing the delicate apparatus within the base by flipping a bistable annular flap from an open position to a closed position after the conduit of the delicate apparatus is wound and after the base is personalized (e.g. user 330 closing base 820 by flipping annular flap 808 from an open position 921 to a closed position 922 with conduit 653 wound around the reel element 259, 859, 1159 therein and after operation 1566. This can occur, for example, in a context in which such a flap 808 is flippably attached to at least one of the barriers 861, 862 (as a generally radial extension thereof, e.g.). Alternatively or additionally, one or both such barriers 861, 862 may be configured to include the reel element or a "second cavity" (polygonal recess 1285 or elongate slot 1295, e.g.) as described herein.

One skilled in the art will recognize that the herein described components (e.g., operations), devices, objects, and the discussion accompanying them are used as examples for the sake of conceptual clarity and that various configuration modifications are contemplated. Consequently, as used herein, the specific exemplars set forth and the accompanying discussion are intended to be representative of their more general classes. In general, use of any specific exemplar is intended to be representative of its class, and the non-inclusion of specific components (e.g., operations), devices, and objects should not be taken limiting.

With respect to the use of substantially any plural and/or singular terms herein, those having skill in the art can translate from the plural to the singular and/or from the singular to the plural as is appropriate to the context and/or application. The various singular/plural permutations are not expressly set forth herein for sake of clarity.

The herein described subject matter sometimes illustrates different components contained within, or connected with, different other components. It is to be understood that such depicted architectures are merely exemplary, and that in fact many other architectures may be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality, and any two components capable of being so associated can also be viewed as being "operably couplable," to each other to achieve the desired functionality. Specific examples of operably couplable include but are not limited to physically mateable and/or physically interacting components, and/or wirelessly interactable, and/or wirelessly interacting components, and/or logically interacting, and/or logically interactable components.

In some instances, one or more components may be referred to herein as "configured to," "configurable to," "operable/operative to," "adapted/adaptable," "able to," "conformable/conformed to," etc. Those skilled in the art will recognize that "configured to" can generally encompass active-state components and/or inactive-state components and/or standby-state components, unless context requires otherwise.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that typically a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B" in respective included configurations.

With respect to the numbered clauses and claims expressed below, all terms therein identify or describe one or more entities described above with particularity. With regard to methods described herein, those skilled in the art will appreciate that recited operations may generally be performed in any order, unless context dictates otherwise. Also, although various operational flows are presented in a sequence(s), it should be understood that the various operations may be performed in other orders than those which are illustrated, or may be performed concurrently. Examples of such alternate orderings may include overlapping, interleaved, interrupted, reordered, incremental, preparatory, supplemental, simultaneous, reverse, or other variant orderings, unless context dictates otherwise. Furthermore, terms like "responsive to," "related to," or other past-tense adjectives are generally not intended to exclude such variants, unless context dictates otherwise. Also in the numbered clauses below, specific combinations of aspects and embodiments are articulated in a shorthand form such that (1) according to respective embodiments, for each instance in which a "component" or other such identifiers appear to be introduced (with "a" or "an," e.g.) more than once in a given chain of clauses, such designations may either identify the same entity or distinct entities; and (2) what might be called "dependent" clauses below may or may not incorporate, in respective embodiments, the features of "independent" clauses to which they refer or other features described above.

CLAUSES

1. A containment system relating to a tag and to an electrical apparatus that includes a first interface and a second interface, the containment system comprising:

a base that includes a reel element having an inside partly bounding a first cavity large enough to contain the first interface of the electrical apparatus and an outside configured to engage a conduit of the electrical apparatus that connects the first and second interfaces of the electrical apparatus and that also includes a first barrier adjoining a first edge of the reel element and partly bounding the first cavity large enough to contain the first interface of the electrical apparatus and that also includes a second barrier adjoining a second edge of the reel element and partly bounding a second cavity configured to grip the tag releasably and partly bounding the first cavity large enough to contain the first interface of the electrical apparatus, the reel element at least partly defining an annulus of the base large enough to receive the conduit of the electrical apparatus.

2. The containment system of any of the above SYSTEM CLAUSES, further comprising:

a device that includes an earbud and a plug, the electrical apparatus being the device, the first interface being the earbud, the second interface being the plug.

3. The containment system of any of the above SYSTEM CLAUSES, further comprising:

a majority (i.e. more than 50% by weight) of the base being made of a material having a tensile modulus on the order of 100 megapascals (within an order of magnitude).

4. The containment system of any of the above SYSTEM CLAUSES, further comprising:

a majority of the second barrier being made of a material having a tensile modulus on the order of 10 megapascals and a median thickness on the order of 1 millimeter.

5. The containment system of claim 1, further comprising:

the second barrier having a median thickness on the order of 1 millimeter.

6. The containment system of any of the above SYSTEM CLAUSES, further comprising:

a majority of the second barrier being made of a synthetic rubber.

7. The containment system of any of the above SYSTEM CLAUSES, further comprising:

at least one of the tag or the second cavity being polygonal.

8. The containment system of any of the above SYSTEM CLAUSES, further comprising:

the electrical apparatus that includes the first interface and the second interface.

9. The containment system of any of the above SYSTEM CLAUSES, further comprising:

the reel element having a median thickness greater than a median thickness of the second barrier.

10. The containment system of any of the above SYSTEM CLAUSES, further comprising:

the reel element having an arcuate cross section.

11. The containment system of any of the above SYSTEM CLAUSES, further comprising:

the second cavity being circular.

12. The containment system of any of the above SYSTEM CLAUSES, further comprising:

the tag not being circular.

13. The containment system of any of the above SYSTEM CLAUSES, further comprising:

the second cavity engaging the tag adhesivelessly.

14. The containment system of any of the above SYSTEM CLAUSES, further comprising:

the tag bearing a distinctive image by which the containment system is customized, the tag being partly within the second cavity.

15. The containment system of any of the above SYSTEM CLAUSES, further comprising:

the tag being a customization tag and being about the same size (incrementally smaller in area, e.g.) as the second cavity.

16. The containment system of any of the above SYSTEM CLAUSES, further comprising:

the tag being a customization tag and having an elongate profile.

17. The containment system of any of the above SYSTEM CLAUSES, further comprising:

the tag including a refractive element (a transparent lens, e.g.).

18. The containment system of any of the above SYSTEM CLAUSES, further comprising:

the tag being a customization tag and including a transparent component having one or more curved surfaces and configured to magnify an image thereof.

19. The containment system of any of the above SYSTEM CLAUSES, further comprising:

the tag being a customization tag, held non-adhesively and partly within the second cavity by a lip of the second barrier.

20. The containment system of any of the above SYSTEM CLAUSES, further comprising:

the tag configured to customize the containment system by expressing a corporate identifier (a trademarked logo or corporate name or slogan, e.g.), the tag being partly within the second cavity.

21. The containment system of any of the above SYSTEM CLAUSES, further comprising:

the tag configured to display language by which the containment system is customized, the tag being partly within the second cavity.

22. The containment system of any of the above SYSTEM CLAUSES, further comprising:

the tag configured to personalize the containment system by expressing a name of a particular human being, the tag being partly within the second cavity.

23. The containment system of any of the above SYSTEM CLAUSES, further comprising:

the tag partly within the second cavity and configured to emit a wireless expression by which the containment system is customized.

24. The containment system of any of the above SYSTEM CLAUSES, further comprising:

the tag being a customization tag and having a median thickness greater than a median thickness of the second barrier.

All of the patents and other publications referred to above are incorporated herein by reference generally—including those identified in relation to particular new applications of existing techniques—to the extent not inconsistent herewith (in each respective latest edition, where applicable). While various system, method, article of manufacture, or other embodiments or aspects have been disclosed above, also, other combinations of embodiments or aspects will be apparent to those skilled in the art in view of the above disclosure. The various embodiments and aspects disclosed above are for purposes of illustration and are not intended to be limiting, with the true scope and spirit being indicated in the final claim set that follows.

What is claimed is:

1. A containment system comprising:

a customization tag;

an electrical apparatus that includes a first interface and a second interface; and a non-customized base that includes a reel element having an inside partly bounding a first cavity large enough to contain the first interface of the electrical apparatus and an outside configured to engage a conduit of the electrical apparatus that connects the first and second interfaces of the electrical apparatus and that also includes a barrier adjoining a first edge of the reel element and partly bounding a first cavity large enough to contain the first interface of the electrical apparatus and that also includes a second barrier adjoining a second edge of the reel element and partly bounding a second cavity configured to grip the customization tag releasably and partly bounding the first cavity large enough to contain the first interface of the electrical apparatus, the containment system being reversibly customized by the second cavity of the non-customized base gripping the customization tag releasably, the reel element at least partly defining an annulus of the base large enough to receive the conduit of the electrical apparatus.

2. The containment system of claim 1, further comprising;

the customization tag being circular and the second cavity not being circular.

3. The containment system of claim 1, further comprising;

a majority of the second barrier being made of a synthetic rubber, the second barrier having a median thickness on the order of 1 millimeter.

4. The containment system of claim 1, further comprising;

the customization tag having a median thickness greater than a median thickness of the second barrier.

5. A containment system relating to a tag and to an electrical apparatus that includes a first interface and a second interface, the containment system comprising;

a base that includes a reel element having an inside partly bounding a first cavity large enough to contain the first interface of the electrical apparatus and also having an outside configured to engage a conduit of the electrical apparatus that connects the first and second interfaces of the electrical apparatus and that also includes a first barrier adjoining a first edge of the reel element and partly bounding the first cavity large enough to contain the first interface of the electrical apparatus and that also includes a second barrier adjoining a second edge of the reel element and partly bounding a second cavity configured to grip the tag releasably and partly bounding the first cavity large enough to contain the first interface of the electrical apparatus, the reel element at least partly defining an annulus of the base large enough to receive the conduit of the electrical apparatus.

6. The containment system of claim 5, further comprising:

a majority of the base being made of a material having a tensile modulus on the order of 100 megapascals.

7. The containment system of claim 5, further comprising:

a majority of the second barrier being made of a material having a tensile modulus on the order of 10 megapascals and a median thickness on the order of 1 millimeter.

8. The containment system of claim 5, further comprising:

a majority of the second barrier being made of a synthetic rubber.

9. The containment system of claim 5, further comprising:

a device that includes an earbud and a plug, the electrical apparatus being the device, the first interface being the earbud, the second interface being the plug.

10. The containment system of claim 5, further comprising:

the second cavity engaging the tag adhesivelessly.

11. The containment system of claim 5, further comprising:

the tag being a customization tag and being about the same size as the second cavity.

12. The containment system of claim 5, further comprising:

The reel element having an arcuate cross section.

13. The containment system of claim 5, further comprising:

the tag being a customization tag and having an elongate profile.

14. The containment system of claim 5, further comprising:

the reel element having a median thickness greater than a median thickness of the second barrier.

15. The containment system of claim 5, further comprising:

the tag, partly within the second cavity and configured to emit a wireless expression by which the containment system is customized.

16. The containment system of claim 5, further comprising:

the tag configured to customize the containment system by expressing a corporate identifier, the tag being party within the second cavity.

17. The containment system of claim 5, further comprising:

the tag being a customization tag, held non-adhesively and partly within the second cavity by a lip of the second barrier.

18. The containment system of claim 5, further comprising:

the second barrier dividing the first and second cavities.

19. The containment system of claim 18, further comprising:

the tag configured to personalize the containment system by expressing a name identifying a human being, the tag being partly within the second cavity.

20. The containment system of claim 18, further comprising:

the tag configured to display language by which the containment system is customized, the tag being partly within the second cavity.

* * * * *